US005513809A

United States Patent [19]

Perkel

[11] Patent Number: 5,513,809

[45] Date of Patent: May 7, 1996

[54] CRYOGENIC VIBRATORY MILL APPARATUS

[75] Inventor: Harold Perkel, Levittown, Pa.

[73] Assignee: TDF, Inc., Levittown, Pa.

[21] Appl. No.: 497,954

[22] Filed: Jul. 3, 1995

[51] Int. Cl.[6] ..... B02C 17/14; B02C 17/20

[52] U.S. Cl. ..... 241/65; 241/67; 241/175; 241/184; 241/DIG. 37

[58] Field of Search ..... 241/65, 67, 171, 241/172, 175, 184, DIG. 31, DIG. 37

[56] References Cited

U.S. PATENT DOCUMENTS

| | | | |
|---|---|---|---|
| 1,169,075 | 1/1916 | Gerlach | 241/184 X |
| 1,696,857 | 12/1928 | Newhouse | 241/171 |
| 1,986,103 | 1/1935 | Cole | 241/171 |
| 3,034,735 | 5/1962 | Cadwell | 241/184 |
| 3,124,314 | 3/1964 | Klein | 241/184 X |
| 3,734,412 | 5/1973 | Haas et al. | 241/15 |
| 3,739,991 | 6/1973 | Wehren et al. | 241/45 |
| 3,774,855 | 11/1973 | Wolf | 241/65 |
| 3,785,575 | 1/1974 | Langmaack et al. | 241/33 |
| 4,085,898 | 4/1978 | Jacubasch et al. | 241/175 |

*Primary Examiner*—John Husar
*Attorney, Agent, or Firm*—Sperry, Zoda & Kane

[57] ABSTRACT

A cryogenic vibratory mill designed to receive cooling fluid such as liquid nitrogen within a grinding chamber for grinding of feed material such as crumb rubber from vehicle tires for cryogenic comminution within a grinding chamber. Cooling within the grinding chamber is achieved by passing cooling fluid such as liquid nitrogen therethrough wherein most of the cooling fluid passes through longitudinal channels formed longitudinally in the cylindrically shaped grinding rods. The operating temperature is normally less than −120 degrees Fahrenheit. A vibrating drive is operative to vibrate the housing and the grinding rods therein to achieve comminution of the feed stock rubber passing therethrough. With this design most of the cooling is achieved by passing of the cooling fluid through the channels defined in the grinding rods with only a minimum amount of cooling achieved by cooling fluid passing through the grinding chamber between the rods.

20 Claims, 4 Drawing Sheets

CRYOGENIC VIBRATORY MILL APPARATUS

BACKGROUND OF THE INVENTION

1. Field of the Invention

The present invention deals with the general field of vibratory mills where a housing defines a milling chamber therein with a plurality of grinding members often freely movable within the chamber for grinding of feed material between the grinding members as well as between the grinding member in the interior of the housing. With certain materials grinding is greatly facilitated by cryogenic treatment of the grinding chamber. When the temperature within the grinding chamber is reduced to a significant level certain feed stock materials such as rubber is made brittle and is much easier to fracture in order to reduce the size of the individual particles thereof.

The present invention deals with the field of cryogenic vibratory mills which include longitudinally extending grinding members therein being particularly usable for grinding of feed material such as the crumb of recycled vehicle tires.

2. Description of the Prior Art

Prior art devices have been designed for this purpose such as shown in U.S. Pat. No. 2,760,727 issued Aug. 28, 1956 to S. Klesskalt and assigned to N.V. Tema on a "Process And Apparatus For Vibratory Grinding"; and U.S. Pat. No. 3,734,412 issued May 22, 1973 to H. Haas et al and assigned to Klockner-Humboldt-Deutz Aktiengesellschaft on a "Method And Arrangement For Performing Low-Temperature Grinding Operations In A Vibrating Mill"; and U.S. Pat. No. 3,739,991 issued Jun. 10, 1973 to P. Wehren et al and assigned to Klockner-Humboldt-Deutz Aktiengesellschaft on a "Vibrating Mill"; and U.S. Pat. No. 3,785,575 issued Jan. 15, 1974 to J. Langmaack and assigned to Klockner-Humboldt-Deutz Aktiengesellschaft on a "Vibrating Mill with Introduction Of Refrigerants Into The Solid Material Being Ground In The Grinding Chamber"; and U.S. Pat. No. 3,813,084 issued May 28, 1974 to J. Langmaack and assigned to Klockner-Humboldt-Deutz Aktiengesellschaft on a "Vibrating Device With A Heat Insulated Treatment Chamber, Particularly A Vibrating Mill"; and U.S. Pat. No. 3,838,825 issued Oct. 1, 1974 to H. Haas et al and assigned to Klockner-Humboldt-Deutz Aktiengesellschaft on a "Vibrating Mill With Heat Insulating Grinding Chamber"; and U.S. Pat. No. 3,944,145 issued Mar. 16, 1976 to G. Eichholz et al and assigned to Klockner-Humboldt-Deutz AG on a "Grinding Mill With Excitation Member In The Charge Of Material To Be Comminuted"; and U.S. Pat. No. 3,949,942 issued Apr. 13, 1976 to H. Haas et al and assigned to Klockner-Humboldt-Deutz Aktiengesellschaft on a "Vibrating Ball Mill With Heat Insulated Grinding Chamber"; and U.S. Pat. No. 4,863,106 issued Sept. 5, 1989 to H. Perkel and assigned to TDF, Inc. on a "Process For Low Temperature Comminution Of Scrap Tires".

SUMMARY OF THE INVENTION

The present invention provides an improved design for a cryogenic vibratory mill which is designed to receive a liquid cooling fluid such as liquid nitrogen for enhancing cryogenic comminution of feed material such as crumb of recycled vehicle tires supplied thereto. The vibratory mill apparatus includes a housing defining a grinding chamber therein which would preferably have a generally cylindrical shape. The housing preferably includes a material inlet in fluid flow communication with respect to the grinding chamber to receive feed material passing therethrough to aid in movement thereof into the grinding chamber.

The housing may also include a material outlet also in fluid flow communication with respect to the grinding chamber in such a manner as to receive material therefrom for exiting.

The housing may also define a cooling fluid inlet in fluid flow communication with respect to the grinding chamber. This cooling fluid inlet is preferably adapted to receive liquid nitrogen for passing therethrough. This housing means preferably also defines a cooling fluid outlet in fluid flow communication with respect to the grinding chamber means and adapted to allow cooling fluid to exit therefrom.

The mill apparatus also preferably includes a cooling fluid distribution device which is adapted to receive liquid nitrogen passing through the cooling fluid inlet for distribution thereof within the grinding chamber as desired. A plurality of nozzles are preferably positioned within the cooling fluid distribution means to further facilitate control of dispensing of liquid nitrogen distributed therethrough.

A plurality of longitudinally extending grinding rods which are formed preferably of alloy steel are included positioned within the grinding chamber. Each grinding rod preferably includes a channel means extending longitudinally therethrough. Each grinding rod preferably also defines a channel inlet and a channel outlet in fluid flow communication with respect to the channel means therein to facilitate the flow of cooling fluid therethrough. The channel means also preferably includes a tapered channel section adjacent to the channel inlet in such a manner as to further facilitate movement of the liquid nitrogen into the channel. The channel inlet is operatively positioned relative to the cooling fluid distribution device and is in fluid flow communication therewith in such a manner as to receive the liquid nitrogen therefrom for passing of the liquid nitrogen through the channel. Preferably the liquid nitrogen will be capable of vaporizing or changing phase within the channel and having the resulting gas therefrom exiting therefrom through the channel outlet to further facilitate cooling of the longitudinal grinding rod along the entire length thereof. The fluid distribution device will preferably be operative to dispense liquid nitrogen through the nozzle into the channel inlet such that at least sixty percent or even more of the liquid nitrogen distributed therethrough will pass through the channel means defined in the multiple grinding rod members in such a manner as to minimize the flow of liquid nitrogen within the grinding chamber in the area between the longitudinally extending rod members. This is preferred since it has been found that the flow of cooling gas through the grinding chamber outside of the grinding rods has a tendency to take up or lift some of the feed stock prior to full grinding thereof which tends to increase the size of the crumb exiting from the vibratory mill which is certainly undesirable.

A vibrating drive is operatively attached within respect to the housing for vibrating thereof and urging movement of the rod members within the grinding chamber to facilitate comminution of the material positioned therewithin. The vibrating device is operative to move the longitudinal grinding members or rod members through a cyclical orbit which is preferably arcuate and of the size of approximately 6–12 millimeters in diameter. This arcuate cyclical orbit of 6–12 millimeters if preferably oriented perpendicularly with respect to the longitudinal axis of the rods.

A discharge plate is preferably positioned within the housing adjacent to the grinding chamber. This discharge plate will define between it and the housing a discharge zone within the grinding chamber. The discharge plate preferably defines a plurality of discharge apertures therein which are adapted to allow feed material to pass therethrough into the discharge zone and on to the material outlet means while at the same time allowing cooling fluid to pass therethrough into the discharge zone and on to the cooling fluid outlet. The discharge apertures however will be small enough to prevent movement of the rod members therethrough and thereby will contain the rod members within the grinding chamber as desired.

A material pre-cooling apparatus may be included for cooling of the feed material prior to passing thereof through the material inlet in such a manner as to further reduce the temperature within the grinding chamber during comminution of the material therein. Additionally an insulation means may extend around the housing to further minimize thermal flow therethrough into the grinding chamber.

A cooling fluid outlet filter will preferably be included extending across the cooling fluid outlet in such a manner as to prevent movement of the material outwardly therethrough. This cooling fluid outlet filter will preferably be formed of a filter cloth material.

A feed plate will preferably include a plurality of feed apertures defined therein. This feed plate will preferably be positioned within the housing between the grinding chamber and the cooling fluid inlet in such a manner as to facilitate control of the cooling fluid or liquid nitrogen passing through the feed aperture means. In this manner the liquid nitrogen will be guided toward the channel inlet means defined in the rod members positioned within the grinding chamber to facilitate cooling of the entire grinding chamber area and certainly cooling of the rods and feed material. The feed plate and the housing together define a fluid distribution chamber positioned between the cooling fluid inlet and the feed plate in order to accumulate a reservoir of liquid nitrogen for supplying thereof to the feed plate for distribution through the feed aperture into the grinding chamber. The feed plate is preferably positioned immediately adjacent the channel inlet of the longitudinal grinding means in such a manner as to facilitate the flow of liquid nitrogen therein and to minimize the movement of material to a position between the feed plate and the grinding rods.

The present invention may further include a pressurization device in fluid flow communication with the cooling fluid inlet and the grinding chamber in order to maintain the pressure within the grinding chamber greater than the atmospheric pressure in order to make the cooling gas therein more dense and further decrease the operating temperature during comminution.

It is an object of the present invention to provide an improved cryogenic vibratory mill apparatus, adapted to receive cooling fluid therein for cryogenic comminution of feed material supplied thereto, wherein cost of capital equipment is minimized.

It is an object of the present invention to provide an improved cryogenic vibratory mill apparatus, adapted to receive cooling fluid therein for cryogenic comminution of feed material supplied thereto, wherein the number of moving parts is minimized.

It is an object of the present invention to provide an improved cryogenic vibratory mill apparatus, adapted to receive cooling fluid therein for cryogenic comminution of feed material supplied thereto, wherein maintenance requirements are minimal.

It is an object of the present invention to provide an improved cryogenic vibratory mill apparatus, adapted to receive cooling fluid therein for cryogenic comminution of feed material supplied thereto, wherein cooling fluid is conserved.

It is an object of the present invention to provide an improved cryogenic vibratory mill apparatus, adapted to receive cooling fluid therein for cryogenic comminution of feed material supplied thereto, wherein effective comminution can occur at approximately −320 degrees Fahrenheit.

It is an object of the present invention to provide an improved cryogenic vibratory mill apparatus, adapted to receive cooling fluid therein for cryogenic comminution of feed material supplied thereto, wherein efficient comminution can occur at any temperature less than −120 degrees Fahrenheit.

It is an object of the present invention to provide an improved cryogenic vibratory mill apparatus, adapted to receive cooling fluid therein for cryogenic comminution of feed material supplied thereto, wherein hot spots along the length of the grinding rods are virtually eliminated.

It is an object of the present invention to provide an improved cryogenic vibratory mill apparatus, adapted to receive cooling fluid therein for cryogenic comminution of feed material supplied thereto, wherein the temperature difference along the length of the grinding rods is minimized.

It is an object of the present invention to provide an improved cryogenic vibratory mill apparatus, adapted to receive cooling fluid therein for cryogenic comminution of feed material supplied thereto, wherein comminution is achievable of extremely small particles since they are not picked up or lifted by large volumes of cooling gas passing between the grinding rods.

It is an object of the present invention to provide an improved cryogenic vibratory mill apparatus, adapted to receive cooling fluid therein for cryogenic comminution of feed material supplied thereto, wherein usage with feed stock materials having low specific gravity is made possible.

It is an object of the present invention to provide an improved cryogenic vibratory mill apparatus, adapted to receive cooling fluid therein for cryogenic comminution of feed material supplied thereto, wherein the grinding rods become the primary source of cryogenic cooling.

It is an object of the present invention to provide an improved cryogenic vibratory mill apparatus, adapted to receive cooling fluid therein for cryogenic comminution of feed material supplied thereto, wherein the heat generated by comminution is quickly dissipated.

It is an object of the present invention to provide an improved cryogenic vibratory mill apparatus, adapted to receive cooling fluid therein for cryogenic comminution of feed material supplied thereto, wherein the transfer of heat generated by the comminution is primarily dissipated by conduction with respect to the grinding rods rather than convection with respect to the surrounding gas.

It is an object of the present invention to provide an improved cryogenic vibratory mill apparatus, adapted to receive cooling fluid therein for cryogenic comminution of feed material supplied thereto, wherein the velocity and volume of cooling fluid passing between the grinding rods is greatly minimized.

It is an object of the present invention to provide an improved cryogenic vibratory mill apparatus, adapted to receive cooling fluid therein for cryogenic comminution of feed material supplied thereto, wherein use with many types of feed stocks is made possible such as minerals, plastics, spices, cosmetics, etc.

It is an object of the present invention to provide an improved cryogenic vibratory mill apparatus, adapted to receive cooling fluid therein for cryogenic comminution of feed material supplied thereto, wherein the vibratory mill has a rotation rate of between 1000–1500 RPM.

It is an object of the present invention to provide an improved cryogenic vibratory mill apparatus, adapted to receive cooling fluid therein for cryogenic comminution of feed material supplied thereto, wherein greater than 60% of the cooling fluid passes through the longitudinal channels defined in the grinding rods.

It is an object of the present invention to provide an improved cryogenic vibratory mill apparatus, adapted to receive cooling fluid therein for cryogenic comminution of feed material supplied thereto, wherein the temperature difference between the channel extending longitudinally through the grinding rod and the exterior surface of the rod is less than 2 degrees under all operating conditions.

It is an object of the present invention to provide an improved cryogenic vibratory mill apparatus, adapted to receive cooling fluid therein for cryogenic comminution of feed material supplied thereto, wherein a much finer material output product can be generated.

It is an object of the present invention to provide an improved cryogenic vibratory mill apparatus, adapted to receive cooling fluid therein for cryogenic comminution of feed material supplied thereto, wherein the feed stock is preferably pre-cooled to enhance comminution thereof and to conserve cooling fluid.

It is an object of the present invention to provide an improved cryogenic vibratory mill apparatus, adapted to receive cooling fluid therein for cryogenic comminution of feed material supplied thereto, wherein the interior of the grinding chamber can be pressurized to make the gas denser to enhance cooling thereby.

It is an object of the present invention to provide an improved cryogenic vibratory mill apparatus, adapted to receive cooling fluid therein for cryogenic comminution of feed material supplied thereto, wherein mesh #10 vehicle tire crumb can be reduced to #40–#100 and smaller vehicle tire mesh crumb in one pass through the cryogenic mill.

It is an object of the present invention to provide an improved cryogenic vibratory mill apparatus, adapted to receive cooling fluid therein for cryogenic comminution of feed material supplied thereto, wherein it takes approximately one to several minutes for feed stock material to pass from the material inlet to the material outlet.

It is an object of the present invention to provide an improved cryogenic vibratory mill apparatus, adapted to receive cooling fluid therein for cryogenic comminution of feed material supplied thereto, wherein the grinding rods are made from alloy steel to prevent the grinding rods from becoming brittle at extremely low temperatures.

It is an object of the present invention to provide an improved cryogenic vibratory mill apparatus, adapted to receive cooling fluid therein for cryogenic comminution of feed material supplied thereto, wherein the vibrating means causes the grinding rods to vibrate through a circular or elliptical path of oscillation having a diameter of approximately 6–12 millimeters.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
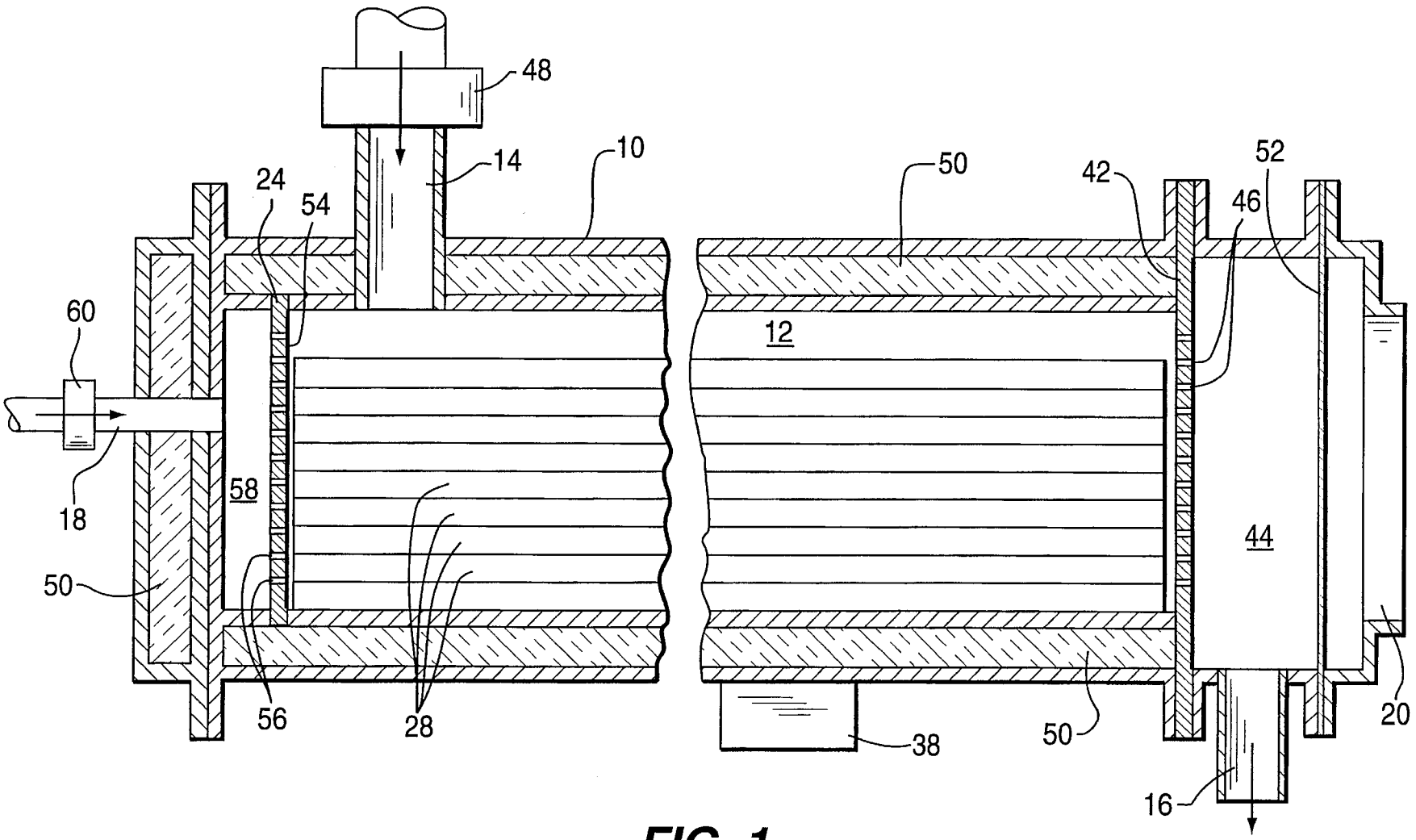
FIG. 1 is a side cross-sectional view of an embodiment of the improved cryogenic vibratory mill apparatus of the present invention.
Figure 2:
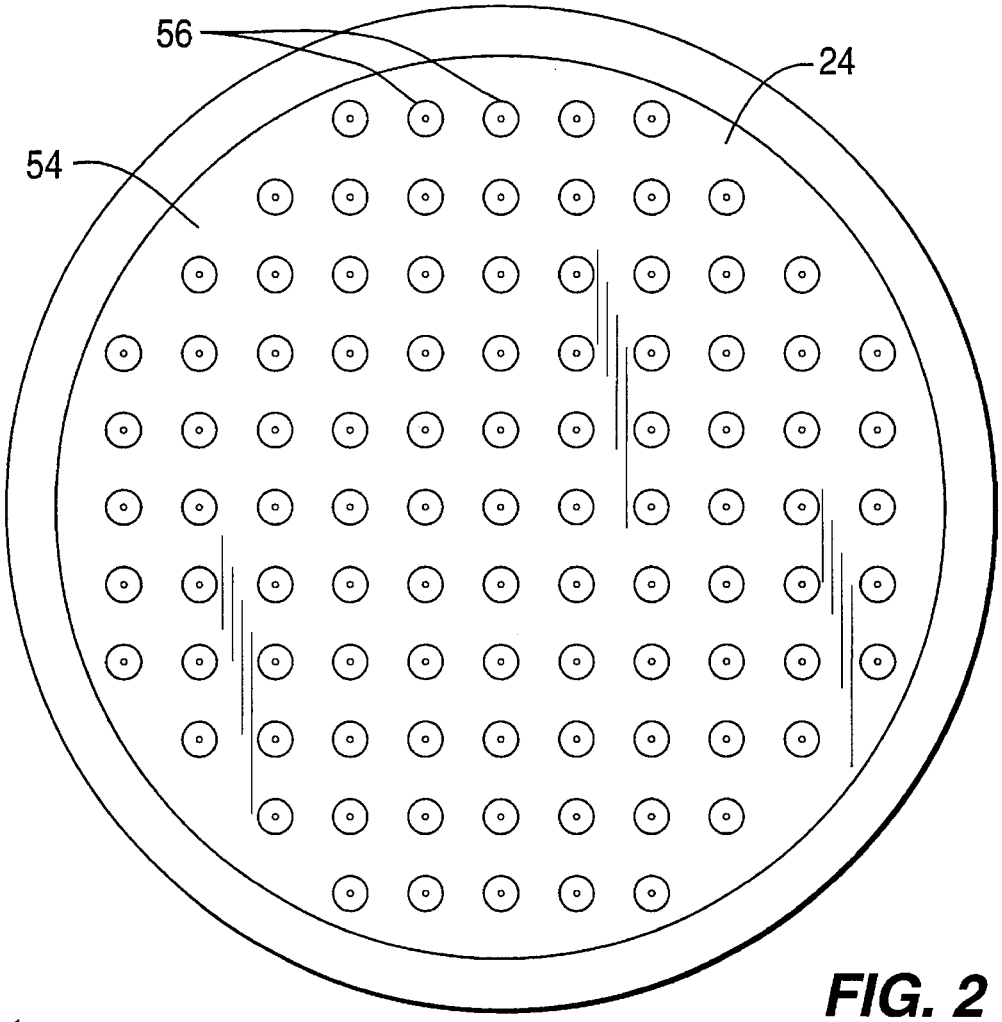
FIG. 2 is a plan view of an embodiment of feed plate which provides the cooling fluid distribution means of the present invention.
Figure 3:
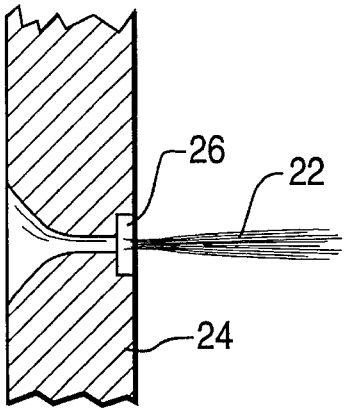
FIG. 3 is a side cross-sectional view of an embodiment of the feed plate showing the nozzles configured in the side thereof facing the grinding chamber.
Figure 4:
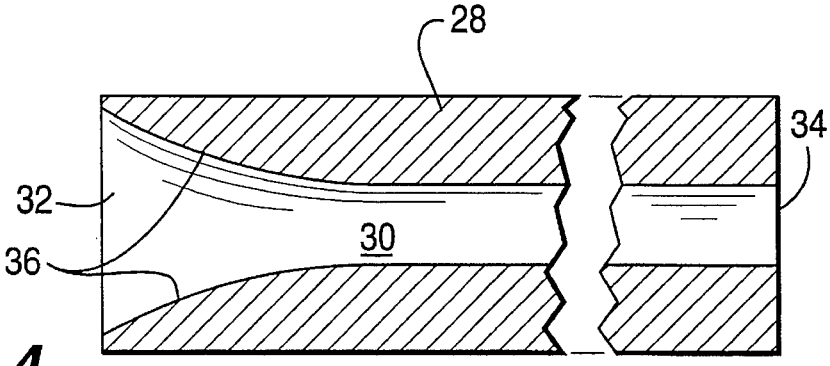
FIG. 4 is a side cross-sectional view of an embodiment of the grinding rod of the present invention showing the channel inlet and the tapered or flared channel section immediately thereadjacent.
Figure 5:
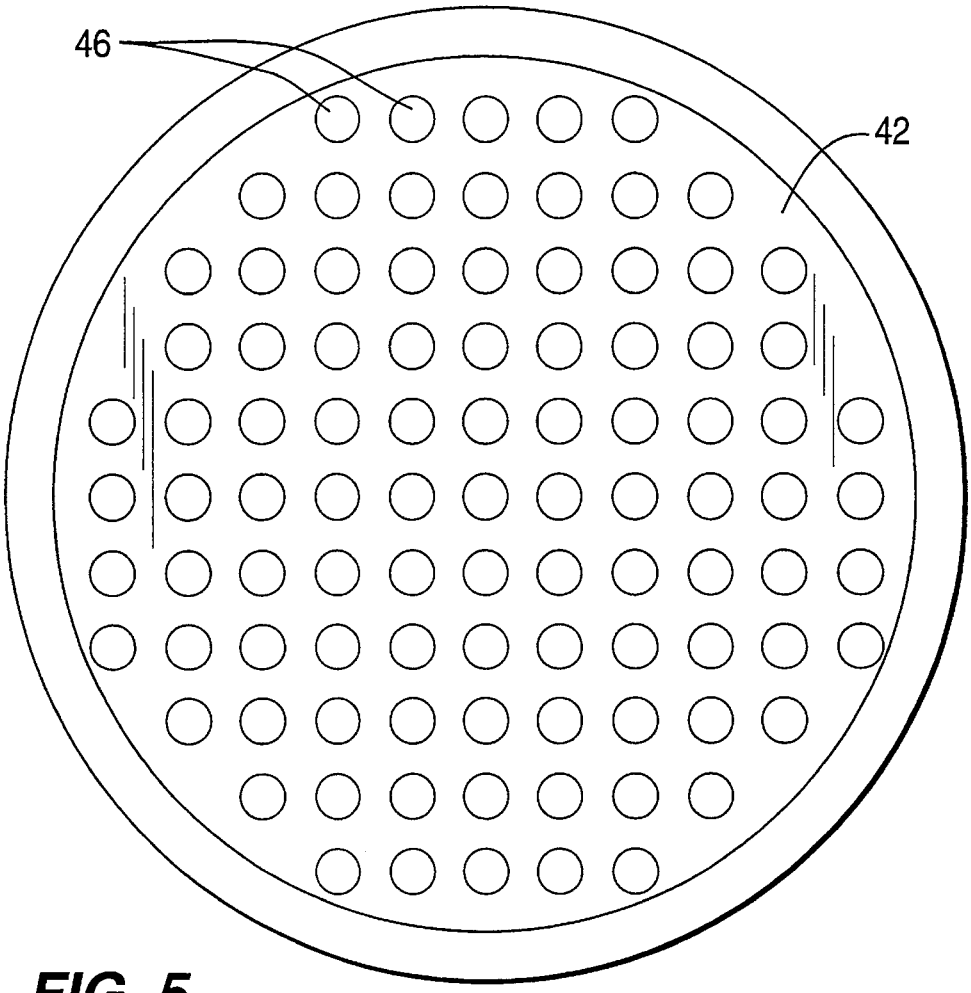
FIG. 5 is a plan view of an embodiment of a discharge plate made in accordance with the present invention.
Figure 6:
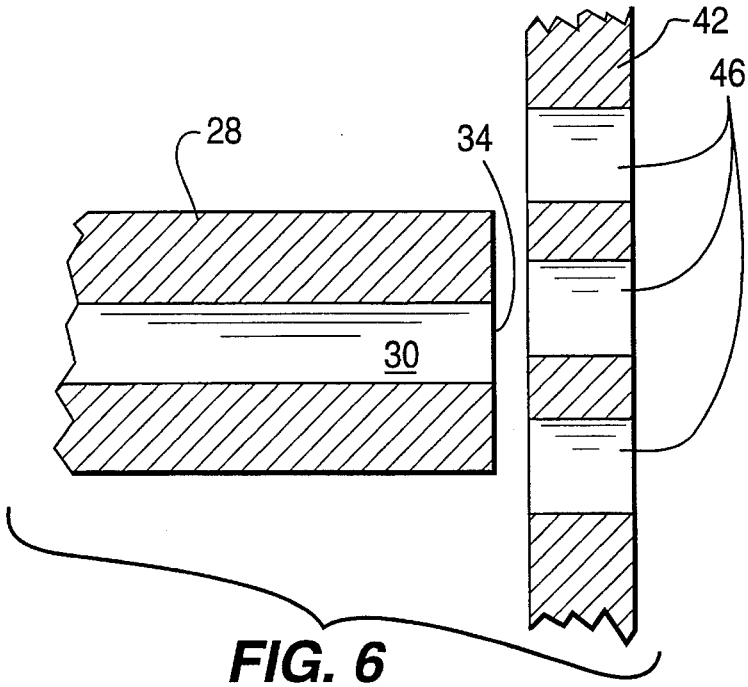
FIG. 6 is a side cross-sectional view of an embodiment of the discharge plate and an embodiment of the grinding rod of the present invention showing the channel outlet thereof immediately adjacent to the discharge apertures defined in the discharge plate.
Figure 7:
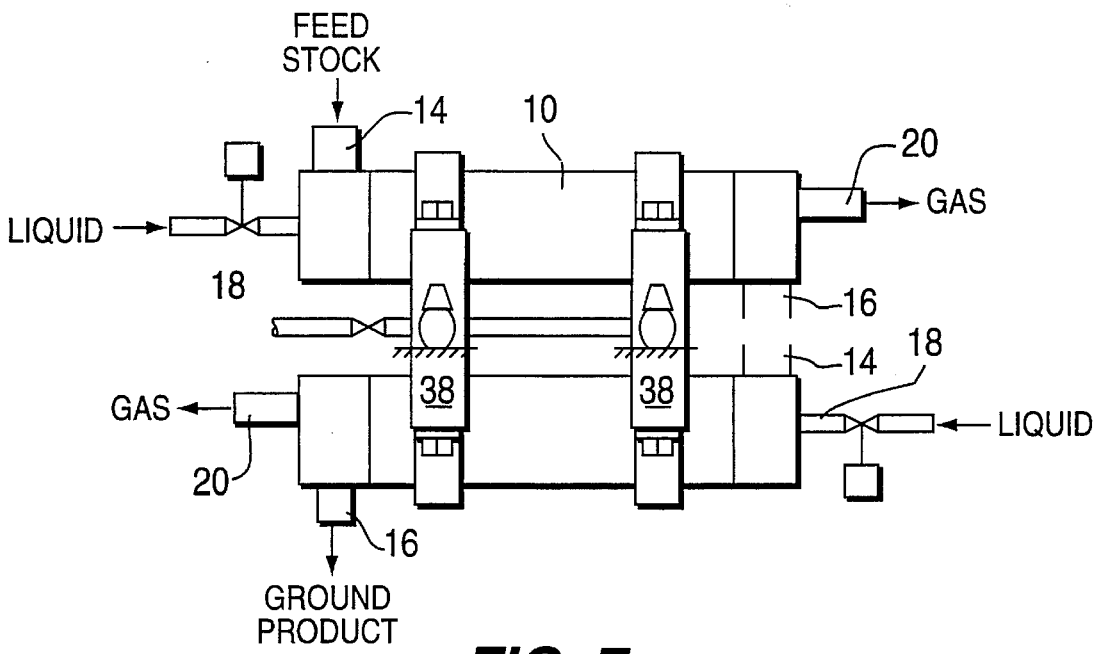
FIG. 7 is a side plan view of an embodiment of the improved cryogenic vibratory mill apparatus of the present invention.

The present invention provides a unique configuration for an improved cryogenic vibratory mill apparatus which is designed to receive liquid cooling fluid 22 for entry therein. Preferably the liquid cooling fluid 22 will comprise liquid nitrogen which is operable for cryogenic systems requiring extremely low temperatures such as between −120 degrees Fahrenheit and −320 degrees Fahrenheit.

The vibratory mill of the present invention includes a housing 10 which defines a grinding chamber 12 therein which preferably is a generally cylindrical shape. Grinding chamber 12 defines a material inlet 14 adapted to receive feed stock material therethrough for grinding. The grinding chamber 12 also preferably defines a material outlet 16 which allows the feed stock after grinding to exit from the grinding chamber. The material exiting through the material outlet can be defined as the product material.

The housing 12 preferably also defines a cooling fluid inlet 18 adapted to receive a cooling fluid such as liquid nitrogen therein to facilitate cooling within the grinding chamber 12. Housing 10 also defines a cooling fluid outlet 20 therein which is adapted to allow the cooling fluid to exit after achieving cryogenic cooling within the grinding chamber 12.

The grinding within the grinding chamber 12 is achieved by a plurality of longitudinal grinding rod members 28. These rod members 28 can be of a significant length of as long as three or four feet or even longer. Each of the longitudinal rod members 28 preferably defines a channel 30 extending longitudinally therethrough. At one end of the rod member 28 a channel inlet 32 will provide direct fluid flow access to the channel 30. At the opposite end of the longitudinal rod 28 preferably a channel outlet 34 will be defined which allows material passing through the channel 30 to exit from the channel 30 of the grinding rod 28. To facilitate the entry of liquid cooling fluid 22 into the channel 30 through the channel inlet 32 preferably immediately adjacent to the channel inlet 32 the portion of the channel 30 will be somewhat flared and will define a tapered channel section 36. This tapered channel section 36 will facilitate the guiding of liquid cooling fluid 22 into the channel 30 in a gradual manner.

The cryogenic vibratory mill of the present invention preferably includes a cooling fluid distribution device 24 such as a feed plate 54 which defines a plurality of feed apertures 56 therein to facilitate the guiding and distribution of liquid cooling fluid 22 therethrough as it passes into the grinding chamber 12. Preferably the feed plate 54 will define a fluid distribution chamber 58 immediately upstream therefrom to provide a reservoir for accumulation of cooling fluid such as liquid nitrogen 22 prior to dispensing thereof through the feed apertures 56 defined in the feed plate 54. To further facilitate guiding of the liquid nitrogen 22 a plurality of nozzles 26 can be positioned within the feed apertures 56 of the feed plate 54. In this manner the liquid nitrogen 22 can be guided by the nozzles 26 toward the cooling fluid inlets 18 defined in each of the grinding rods 28 in such a manner that most of the cooling fluid will pass through the channels 30 defined therein. It is acceptable for a minimal amount of cooling fluid to pass between the grinding rods 28. However, as much of that cooling fluid as possible will preferably pass through the channel 30.

The housing 10 is operatively connected with respect to a vibrating device 38 which is operable to vibrate the housing 10 as well as the grinding rods 28 loosely positioned within the grinding chamber 12. The vibrating device 38 is operative to move the rods through a cyclical orbit which will normally be arcuate and is preferably of a diameter of between 6–12 millimeters. This small amount of vibration is useful in order to achieve the comminution of the feed material within the grinding chamber 12 between the grinding rods 28 and between the grinding rods 28 and the interior wall of the grinding chamber 12.

The grinding rods 28 are contained within the grinding chamber 12 by a discharge plate 42. Preferably discharge plate 42 defines a discharge zone 44 downstream therefrom. The discharge plate 42 defines discharge apertures 46 therein which are small enough to prevent the longitudinal grinding rods 28 from moving therethrough. At the same time, however, discharge apertures 46 are large enough to obviously allow the cooling fluid 22 to pass therethrough to the cooling fluid outlet 20 but more importantly are of a large enough dimension to allow the material product to pass therethrough to the material outlet 16.

Grinding or comminution of the feed stock is significantly enhanced by reducing the temperature within the grinding chamber 12. Reduction of this comminution temperature as well as conserving of cooling fluid is achieved by the use of a material pre-cooling means 48 positioned adjacent the material inlet 14 and upstream thereof. Pre-cooling of the recycled tire crumb will aid in grinding thereof and will significantly reduce the operating temperature within the grinding chamber 12. To further reduce the temperature an insulation means 50 may be positioned extending about the housing as shown in FIG. 1 to further minimize the flow of any heat from the external ambient environment into the cryogenic grinding chamber 12.

A cooling fluid outlet filter 52 may be positioned extending across the cooling fluid outlet 20 to prevent the movement of any product material outwardly therethrough. Preferably the cooling fluid outlet filter 52 will comprise a filter cloth which has been found to be particularly effective in allowing the spent cooling fluid to pass therethrough while at the same time preventing the movement of any material product therethrough and urging thereof toward the material outlet 16.

A pressurization means 60 may be included in the present design for supplying of the liquid cooling fluid 22 into the grinding chamber 12 at an increased pressure in order to make the pressure within the grinding chamber 12 greater than atmospheric pressure which will make the cooling fluid gas more dense and enhance cryogenic cooling. It is anticipated that if liquid nitrogen is used as the cooling fluid 22 it will be dispensed through the nozzles 26 through the channel inlet 32 into the channel 30 defined within the grinding rods. The grinding themselves will generate heat by the grinding or comminution of the products on the exterior peripheral surface thereof. This heat will tend to cause a phase change or vaporize the liquid nitrogen 22 as it passes through the channel 30. By the time the cooling fluid reaches the channel outlet 34 most likely the liquid nitrogen 22 will all have changed to gaseous phase. It is this gas which is preferably made more dense by the inclusion of a pressurization means to increase the cryogenic characteristics of the vibratory mill of the present invention.

The present invention is particularly advantageous since in the prior art any use of gas in a vibratory mill for cooling or other purposes tends to interfere with the comminuting process. This interference is because the grinding creates smaller and smaller particles which can easily be picked up by the liquid cooling fluid 22 as it passes through the grinding chamber 12 between the grinding rods 28. These small particles can be picked up by this flowing gas and carried along with it to artificially move this product which has not yet been completely fractured or reduced in size. Thus comminution of this picked up material can be prevented and this is particularly a problem when the feed stock material has a low specific gravity. The present invention overcomes this problem by minimizing the flow of fluid and in particular cooling fluid in the area where grinding or comminution actually occurs. By isolating the cooling fluid movement physically from the location of grinding while at the same time allowing full thermal transfer between the point of grinding and the cryogenic fluid a much more efficiently designed cryogenic mill is possible.

This improvement is because the largest portion of the required cooling gas passes through the channels 30 in the grinding rods 28. The actual gas velocity which will be permitted between the grinding rods 28 to provide a minimum of disturbance to the process is dependent upon the particle size to be generated and its specific gravity. These parameters can be calculated to determine the operating conditions of a specific cryogenic vibratory mill.

It should be appreciated that an important aspect of the present invention is in the conversion of the grinding rods 28 to be the major contributor to the heat transfer process. In the prior art heat travels from the particle to the surrounding gas by convection. This heat is actually generated at the surface of the interface between the grinding rods 28 and the particles of feed stock material. Thus the grinding rod 28 must transfer its heat radially to the surrounding gas. The removal of heat in this manner generated by the grinding process with this configuration of the prior art is accomplished by a steady flow of cooling gas at a velocity which achieves not only the desired objective of removing heat but also unintentionally picks up the smaller of the ground particles prior to full grinding thereof.

The vibrating drive 38 of the apparatus of the present invention is designed to rotate the grinding rods 28 through an arcuate path which normally will be either circular or elliptical and will be of a diameter of normally between 6 and 12 millimeters. This very small rotation normally referred to more accurate as vibration will occur at a speed of approximately 1000–1500 revolutions per minute. As these grinding rods 28 move through this path of movement they will be receiving cooling fluid 22 from the nozzles 26 of the cooling fluid distribution means 24 referred to as the feed plate 54. The position that the nozzle 26 will dispense cooling fluid will be fixed and the ratio of the size of the channel inlet 32 in relation to the positioning of the feed apertures 56 and the feed plate 54 are critical in order to maximize the movement of cooling fluid 22 into the channels 30 and minimize the flow thereof between the grinding rods 28.

The path of the incoming cooling fluid 22 will impinge on two well defined areas. The first area is defined by the opening in the end of the rod and we will refer to this as (A1). This area (A1) is equal to 90% of the area of each rod which is defined as 90% of the cross-sectional area of each rod which is defined as (Ar). The other defined area is the area of the tube which contains the bundle of N rods which is called (At).

The cooling fluid 22 entering through the feed plate 54 will either go into the openings in the rods or will go between the rods in the following proportions on average unless we take further steps to direct the flow.

$$\%\ \text{Fluid exterior to rods} = \frac{At - (.9N)\,(Ar)}{At} \times 100 \qquad \text{I}$$

$$\%\ \text{Fluid entering rods} = \frac{(.9N)\,(Ar)}{At} \times 100 \qquad \text{II}$$

A numerical example will show the significance of these two equations. If we selected the diameter and the number of rods such that they occupied 70% of the tube volume then equation I would equal 37% and equation II would account for 63%. These results show that the present invention in its most simplest form will greatly reduce the fluid which could disturb the comminution process to nearly one-third of that currently used in the prevalent practice. In addition no "hot spots" can occur because the rods 28 will be cooled throughout the length to a temperature that will maintain the condition required for brittle fracture of the feed material. The distribution of the fluid 22 is governed by the equations I and II because the rods 28 and the fluid 22 are related by a random process that insures on average the flow will be divided in proportion to the area in which the fluid is impinging. This prediction has been proved experimentally. This invention takes advantage of the fact that the difference in temperature between the outside diameter of the channel 30 and the outer surface of the rod 28 will be less than 2 degrees under all operating conditions whether liquid or gas is flowing through the channel 30 while transferring the maximum amount of heat generated at the exterior surface of the grinding rod 28 by comminution. To match the amount of heat transfer required in the conventional practice the temperature difference required between the outer surface of rod 28 and the surrounding gas is more than an order of magnitude greater, typically 30 to 100 degrees. This is a serious deficiency in the present state of the art because to maintain this large temperature difference subjects the devices made in accordance with the prior art to "hot spots" along the length of the rod 28 and requires a greater flow of cryogenic fluid 22 to maintain the outer surface temperature of rod 28 at a level which permits efficient comminution to occur. This comminution temperature at the interface between the feed stock and the outer surface of rod 28 is controlled in this improved embodiment by the pressure in the liquid chamber shown in FIG. 1. This represents a significant reduction in the amount of controls used in the present art. A single setting of the fluid supply establishes the pressure in the liquid chamber of FIG. 1 and can determine the flow into the channels 30 of the rods 28 and the area surrounding the rods 28 and the important ratio therebetween.

The use of the liquid feed plate 54 and the individual nozzles 26 can be chosen of a size to operate under a wide range of pressures to deliver the wide range of flows which may be required for specific production rates of materials that, for example, require large amounts of cooling. On the other hand, if a different product is to be processed that produces far less heat during grinding thereof, then a new design of the feed plate 54 could be utilized having smaller apertures 56 therein and smaller nozzles 26 as necessary. Such an additional feed plate 54 would operate under the same pressure range as any other plate but would deliver much less flow while maintaining the required comminution temperatures.

The vibratory mill shown in accordance with this preferred embodiment of the present invention operates on the basis of the displacement principle. That is, the material flows through the machine by virtue of pressure provided by the weight of the incoming feed stock. This implies that some of the incoming particles could flow to the left toward the space between the liquid feed plate and the rods. This problem can be overcome by maintaining the space between the rods 28 and the feed plate 54 as small as practical such that the vast majority of the incoming feed stock will move to the right and be subject to full comminution. A small fraction of the feed stock which goes to the left may indeed enter the channel inlet 32 and pass through the channel 30 and be flushed through the system without any serious reduction in efficiency of operation of the system. It should also be noted that the spray of liquid 22 from the nozzles 26 in the feed plate 54 tend to drive the particles away from the left side of the grinding chamber 12 and aid in natural flow of incoming material toward the preferred direction which is downstream toward the material outlet 16.

Figure 8:
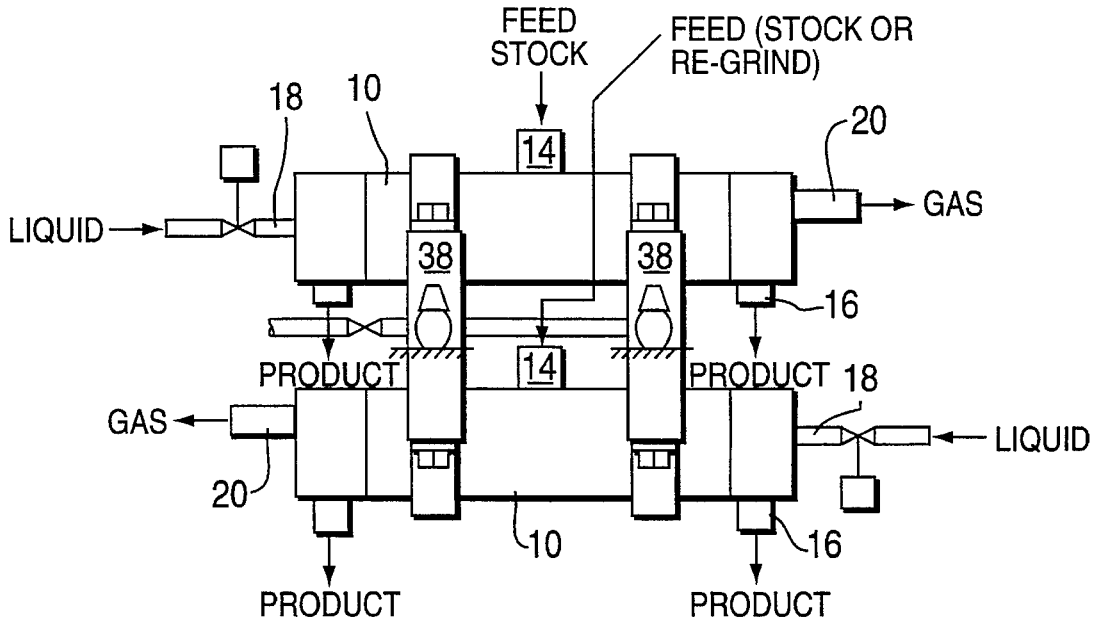
FIG. 8 is a side view of an alternative configuration of the improved cryogenic vibratory mill apparatus of the present invention.
Figure 9:
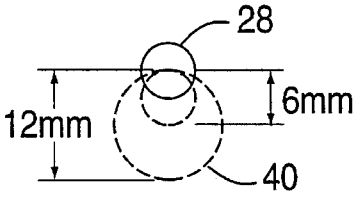
FIG. 9 is an end view of a single longitudinal grinding rod member showing an example of a circular or elliptical path of movement thereof.

Another configuration of the improved cryogenic vibratory mill apparatus of the present invention is shown in FIG. 8. In this configuration the feed stock enters the central area of the grinding chamber 12 and flows toward each opposite end. In this case each housing 10 becomes an independent grinding device with half the grinding path as that shown in the configuration of FIG. 1. This alternative as shown in FIG. 8 may be the most preferable when used for applications of this invention under certain conditions because a negligible amount of the feed stock material will be capable of entering the channels 30 defines in the longitudinal grinding rod 28. The second or lower housing may then serve as a second stage of comminution or simply provide double capacity of operation. In these systems two separate housings 10 are often positioned adjacent to one another to take advantage of a single vibratory drive to provide further reduction in the size of the feed product or to double the capacity of the system.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved cryogenic vibratory mill apparatus, for receiving cooling fluid therein for cryogenic comminution of feed material supplied thereto, comprising:

A. a housing means defining a grinding chamber means therein, said housing means defining a material inlet means in fluid flow communication with respect to said grinding chamber means to receive feed material passing therethrough for facilitating movement thereof into said grinding chamber means, said housing means further defining a material outlet means in fluid flow communication with respect to said grinding chamber means to receive material therefrom for exiting therefrom, said housing means further defining a cooling fluid inlet means in fluid flow communication with respect to said grinding chamber means, said cooling fluid inlet means for receiving cooling fluid for passing therethrough, said housing means further defining a cooling fluid outlet means in fluid flow communication with respect to said grinder chamber means and for allowing cooling fluid to exit therefrom;

a cooling fluid distribution means for receiving cooling fluid passing through said cooling fluid inlet means for distribution thereof within said grinding chamber means;

C. a plurality of longitudinal grinding members each defining a channel means extending longitudinally therethrough, said longitudinal grinding members further defining a channel inlet means and a channel outlet means in fluid flow communication with respect to said channel means to facilitate flow of fluid therethrough, said channel inlet means being operatively positioned relative to said cooling fluid distribution means and in fluid flow communication therewith to receive cooling fluid therefrom for passing of the cooling fluid through said channel means and exiting therefrom through said channel outlet means to facilitate cooling along the length of said longitudinal grinding members; and D. a vibrating means operatively attached with respect to said housing means for vibrating thereof and for urging movement of said longitudinal grinding members within said grinding chamber means to facilitate comminution of material positioned within said grinding chamber means.

2. An improved cryogenic vibratory mill apparatus, for receiving cooling fluid therein for cryogenic comminution of feed material supplied thereto, as defined in claim 1 wherein said longitudinal grinding members comprising rod members.

3. An improved cryogenic vibratory mill apparatus, for receiving cooling fluid therein for cryogenic comminution of feed material supplied thereto, as defined in claim 1 wherein said grinding chamber means is of a cylindrical shape with said cooling fluid inlet means positioned adjacent one end thereof and said cooling fluid outlet means positioned adjacent the opposite end thereof.

4. An improved cryogenic vibratory mill apparatus, for receiving cooling fluid therein for cryogenic comminution of feed material supplied thereto, as defined in claim 1 wherein said channel inlet means includes a tapered channel section to provide a wider cross-sectional area to facilitate movement of cooling fluid from said cooling fluid distribution means into said channel means.

5. An improved cryogenic vibratory mill apparatus, for receiving cooling fluid therein for cryogenic comminution of feed material supplied thereto, as defined in claim 1 further comprising an insulation means extending around said housing means to minimize thermal flow through said housing means into said grinding chamber means.

6. An improved cryogenic vibratory mill apparatus, for receiving cooling fluid therein for cryogenic comminution of feed material supplied thereto, as defined in claim 1 further comprising a discharge plate means positioned within said housing means adjacent said grinding chamber means, said discharge plate means along with said housing means defining a discharge zone therewithin between said grinding chamber means and said material outlet means and between said grinding chamber means and said cooling fluid outlet means, said discharge plate means defining discharge aperture means therein for allowing material to pass therethrough into said discharge zone and to said material outlet means and to allow cooling fluid to pass therethrough into said discharge zone and to said cooling fluid outlet means, said discharge aperture means defined in said discharge plate means being small enough to prevent movement of said longitudinal grinding members therethrough in order for containment thereof within said grinding chamber means.

7. An improved cryogenic vibratory mill apparatus, for receiving cooling fluid therein for cryogenic comminution of feed material supplied thereto, as defined in claim 1 further comprising a cooling fluid outlet filter means extending across said cooling fluid outlet means to prevent movement of material outwardly therethrough.

8. An improved cryogenic vibratory mill apparatus, for receiving cooling fluid therein for cryogenic comminution of feed material supplied thereto, as defined in claim 7 wherein said cooling fluid outlet filter means comprises a filter cloth means.

9. An improved cryogenic vibratory mill apparatus, for receiving cooling fluid therein for cryogenic comminution of feed material supplied thereto, as defined in claim 1 wherein said cooling fluid distribution means further includes a feed plate means defining a feed aperture means therein, said feed plate means positioned within said housing means between said grinding chamber means and said cooling fluid inlet means to facilitate control of cooling fluid passing through said feed aperture means for guiding thereof toward said channel inlet means defined in said longitudinal grinding members positioned within said grinding chamber means to facilitate cooling thereof, said feed plate and said housing means together defining a fluid distribution chamber means between said cooling fluid inlet means and said feed plate means to accumulate a reservoir of cooling fluid for supplying thereof to said feed plate means for distribution thereof through said feed aperture means into said grinding chamber means.

10. An improved cryogenic vibratory mill apparatus, for receiving cooling fluid therein for cryogenic comminution of feed material supplied thereto, as defined in claim 9 wherein said longitudinal grinding members are positioned immediately adjacent said feed plate means to facilitate flow of cooling fluid therefrom into said channel inlet means and to minimize movement of material between said feed plate means and said longitudinal grinding members.

11. An improved cryogenic vibratory mill apparatus, for receiving cooling fluid therein for cryogenic comminution of feed material supplied thereto, as defined in claim 9 further comprising nozzle means positioned within said feed aperture means defined in said feed plate means to facilitate control of cooling fluid distributed therethrough.

12. An improved cryogenic vibratory mill apparatus, for receiving cooling fluid therein for cryogenic comminution of feed material supplied thereto, as defined in claim 1 further comprising a material pre-cooling means for cooling of the feed material prior to passing through said material inlet means to further reduce the temperature within said grinding chamber means during comminution of material therein.

13. An improved cryogenic vibratory mill apparatus, for receiving cooling fluid therein for cryogenic comminution of feed material supplied thereto, as defined in claim 1 further comprising a liquid cooling fluid to be supplied to said material inlet means for distribution by said cooling fluid distribution means in liquid form through said channel inlet means into said channel means defined longitudinally with said longitudinal grinding members for cooling thereof, said liquid cooling fluid being operative to change phase and become a gas for further absorbing heat from said longitudinal grinding members while passing through said channel means defined therein.

14. An improved cryogenic vibratory mill apparatus, for receiving cooling fluid therein for cryogenic comminution of feed material supplied thereto, as defined in claim 13 wherein said liquid cooling fluid comprises liquid nitrogen.

15. An improved cryogenic vibratory mill apparatus, for receiving cooling fluid therein for cryogenic comminution of feed material supplied thereto, as defined in claim 1 wherein said longitudinal grinding members are made of alloy steel.

16. An improved cryogenic vibratory mill apparatus, for receiving cooling fluid therein for cryogenic comminution of feed material supplied thereto, as defined in claim 1 further comprising a pressurization means in fluid flow communication with said cooling fluid inlet means and said grinding chamber means to maintain the pressure within said grinding chamber greater than atmospheric pressure to further decrease the operating temperature therewithin.

17. An improved cryogenic vibratory mill apparatus, for receiving cooling fluid therein for cryogenic comminution of feed material supplied thereto, as defined in claim 1 wherein greater than 60% of the cooling fluid entering said grinding chamber means through said cooling fluid distribution means passes through said channel means defined in said longitudinal grinding members to enhance cooling thereof and to minimize flow of cooling fluid therebetween.

18. An improved cryogenic vibratory mill apparatus, for receiving cooling fluid therein for cryogenic comminution of feed material supplied thereto, as defined in claim 1 wherein said vibrating means is operative to move said longitudinal grinding members through an arcuate cyclical orbit of approximately six to twelve millimeters in diameter extending perpendicularly to the axes thereof.

19. An improved cryogenic vibratory mill apparatus, for receiving liquid cooling fluid therein for cryogenic comminution of feed material supplied thereto, comprising:

A. a housing means defining a grinding chamber means therein, said housing means defining a material inlet means in fluid flow communication with respect to said grinding chamber means to receive feed material passing therethrough for facilitating movement thereof into said grinding chamber means, said housing means further defining a material outlet means in fluid flow communication with respect to said grinding chamber means to receive material therefrom for exiting therefrom, said housing means further defining a cooling fluid inlet means in fluid flow communication with respect to said grinding chamber means, said cooling fluid inlet means for receiving liquid cooling fluid for passing therethrough, said housing means further defining a cooling fluid outlet means in fluid flow communication with respect to said grinder chamber means and for allowing liquid cooling fluid to exit therefrom;

B. a cooling fluid distribution means for receiving liquid cooling fluid passing through said cooling fluid inlet means for distribution thereof within said grinding chamber means;

C. a plurality of nozzle means positioned within said cooling fluid distribution means to facilitate control of liquid cooling fluid distributed therethrough;

D. a plurality of longitudinal grinding rod members each defining a channel means extending longitudinally therethrough, said longitudinal grinding rod members further defining a channel inlet means and a channel outlet means in fluid flow communication with respect to said channel means to facilitate flow of fluid therethrough, said channel means also including a tapered channel section adjacent said channel inlet means to further facilitate movement of liquid cooling fluid into said channel means, said channel inlet means being operatively positioned relative to said cooling fluid distribution means and in fluid flow communication therewith to receive liquid cooling fluid therefrom for passing of the liquid cooling fluid through said channel means and exiting therefrom through said channel outlet means to facilitate cooling along the length of said longitudinal grinding rod members;

E. a vibrating means operatively attached with respect to said housing means for vibrating thereof and for urging movement of said longitudinal grinding rod members within said grinding chamber means to facilitate comminution of material positioned within said grinding chamber means, said vibrating means being operative to move said longitudinal grinding rod members through an arcuate cyclical orbit of approximately six to twelve millimeters in diameter extending perpendicularly to the axes thereof;

F. a discharge plate means positioned within said housing means adjacent said grinding chamber means, said discharge plate means along with said housing means defining a discharge zone therewithin between said grinding chamber means and said material outlet means and between said grinding chamber means and said cooling fluid outlet means, said discharge plate means defining a discharge aperture means therein adapted to allow material to pass therethrough into said discharge zone and to said material outlet means and to allow liquid cooling fluid to pass therethrough into said discharge zone and to said cooling fluid outlet means, said discharge aperture means defined in said discharge plate means being small enough to prevent movement of said longitudinal grinding members therethrough in order for containment thereof within said grinding chamber means; and G. a material pre-cooling means for cooling of the feed material prior to passing through said material inlet means to further reduce the temperature within said grinding chamber means during comminution of material therein.

20. An improved cryogenic vibratory mill apparatus, for receiving a liquid cooling fluid such as liquid nitrogen therein for cryogenic comminution of feed material supplied thereto, comprising:

A. a housing means defining a grinding chamber means therein of generally cylindrical shape, said housing means defining a material inlet means in fluid flow communication with respect to said grinding chamber means to receive feed material passing therethrough for facilitating movement thereof into said grinding chamber means, said housing means further defining a material outlet means in fluid flow communication with respect to said grinding chamber means to receive material therefrom for exiting therefrom, said housing means further defining a cooling fluid inlet means in fluid flow communication with respect to said grinding chamber means, said cooling fluid inlet means for receiving liquid nitrogen for passing therethrough, said housing means further defining a cooling fluid outlet means in fluid flow communication with respect to said grinder chamber means and for allowing cooling fluid to exit therefrom;

B. a cooling fluid distribution means for receiving liquid nitrogen passing through said cooling fluid inlet means for distribution thereof within said grinding chamber means;

C. a plurality of nozzle means positioned within said cooling fluid distribution means to facilitate control of liquid nitrogen distributed therethrough;

D. a plurality of longitudinal grinding rod members made of alloy steel and each defining a channel means extending longitudinally therethrough, said longitudinal grinding rod members further defining a channel inlet means and a channel outlet means in fluid flow communication with respect to said channel means to facilitate flow of fluid therethrough, said channel means also including a tapered channel section adjacent said channel inlet means to further facilitate movement of liquid nitrogen into said channel means, said channel inlet means being operatively positioned relative to said cooling fluid distribution means and in fluid flow communication therewith to receive liquid nitrogen therefrom for passing of the liquid nitrogen through said channel means and vaporizing thereof within said channel means and exiting of the cooling fluid therefrom through said channel outlet means to facilitate cooling along the length of said longitudinal grinding rod members, said fluid distribution means operative to dispense liquid nitrogen through said nozzle means into said channel inlet means such that at least sixty percent of the liquid nitrogen distributed therethrough passes through said channel means defined in said longitudinal grinding rod members to minimize flow of liquid nitrogen within said grinding chamber means in the area between said longitudinal grinding rod members;

E. a vibrating means operatively attached with respect to said housing means for vibrating thereof and for urging movement of said longitudinal grinding rod members within said grinding chamber means to facilitate comminution of material positioned within said grinding chamber means, said vibrating means being operative to move said longitudinal grinding rod members through an arcuate cyclical orbit of approximately six to twelve millimeters in diameter extending perpendicularly to the axes thereof;

F. a discharge plate means positioned within said housing means adjacent said grinding chamber means, said discharge plate means along with said housing means defining a discharge zone therewithin between said grinding chamber means and said material outlet means and between said grinding chamber means and said cooling fluid outlet means, said discharge plate means defining a discharge aperture means therein for allowing material to pass therethrough into said discharge zone and to said material outlet means and to allow cooling fluid to pass therethrough into said discharge zone and to said cooling fluid outlet means, said discharge aperture means defined in said discharge plate means being small enough to prevent movement of said longitudinal grinding rod members therethrough in order for containment thereof within said grinding chamber means;

G. a material pre-cooling means for cooling of the feed material prior to passing through said material inlet means to further reduce the temperature within said grinding chamber means during comminution of material therein;

H. an insulation means extending around said housing means to minimize thermal flow therethrough into said grinding chamber means;

I. a cooling fluid outlet filter means extending across said cooling fluid outlet means to prevent movement of material outwardly therethrough, said cooling fluid outlet filter means comprising a filter cloth means;

J. a feed plate means defining a feed aperture means therein, said feed plate means positioned within said housing means between said grinding chamber means and said cooling fluid inlet means to facilitate control of liquid nitrogen passing through said feed aperture means for guiding thereof toward said channel inlet means defined in said longitudinal grinding rod members positioned within said grinding chamber means to facilitate cooling thereof, said feed plate and said housing means together defining a fluid distribution chamber means between said cooling fluid inlet means and said feed plate means to accumulate a reservoir of liquid nitrogen for supplying thereof to said feed plate means for distribution thereof through said feed aperture means into said grinding chamber means, said feed plate means being positioned immediately adjacent said channel inlet means of said longitudinal grinding rod means to facilitate flow of liquid nitrogen therein and to minimize movement of material between said feed plate means and said longitudinal grinding rod members; and K. a pressurization means in fluid flow communication with said cooling fluid inlet means and said grinding chamber means to maintain the pressure within said grinding chamber greater than atmospheric pressure to further decrease the operating temperature therewithin.

* * * * *